United States Patent [19]

Berdinner, Jr. et al.

[11] Patent Number: 4,475,478

[45] Date of Patent: Oct. 9, 1984

[54] COATING APPARATUS

[75] Inventors: Edward J. Berdinner, Jr.; Jerome P. Throckmorton, both of Longmont, Colo.

[73] Assignee: International Business Machines Corporation, Armonk, N.Y.

[21] Appl. No.: 483,459

[22] Filed: Apr. 8, 1983

[51] Int. Cl.[3] ..... B05C 5/00

[52] U.S. Cl. ..... 118/413; 118/407; 101/366

[58] Field of Search ..... 118/410, 413, 411, 407, 118/DIG. 4; 101/366; 425/113

[56] References Cited

U.S. PATENT DOCUMENTS

| | | | |
|---|---|---|---|
| 2,734,224 | 2/1956 | Wenstead | 118/410 X |
| 3,081,191 | 3/1963 | Smith et al. | 117/64 |
| 3,717,121 | 2/1973 | Bruckbauer et al. | 118/DIG. 4 |
| 4,038,442 | 7/1977 | Utumi | 427/128 |
| 4,142,010 | 2/1979 | Pipkin et al. | 427/355 |
| 4,299,186 | 11/1981 | Pipkin et al. | 118/407 |
| 4,345,543 | 8/1982 | Pipkin | 118/106 |

*Primary Examiner*—John P. McIntosh
*Attorney, Agent, or Firm*—Francis A. Sirr

[57] ABSTRACT

A moving web is coated on one side thereof by passing the web through an elongated pool of coating liquid. The pool is replenished by an elongated manifold having an internal, elongated, uniform-cross section, runner conduit which is supplied with liquid from at least one inlet port, located generally at its midpoint. Ink flows from the runner conduit, to the pool, by passing through a plurality of flow-restricting slots. The slots provide greater restriction to flow adjacent the inlet port, than at the two ends of the runner conduit.

5 Claims, 4 Drawing Figures

COATING APPARATUS

TECHNICAL FIELD

This invention relates to the field of substrate or web coating apparatus.

BACKGROUND OF THE INVENTION

The present invention relates to coating a moving substrate or web with a coating fluid or liquid by passing the web into contact with a liquid pool, so that a portion of the pool is carried away as a thin coating on at least one side of the web.

The present invention finds utility, for example, in the manufacture of flexible xerographic photoconductor media and flexible magnetic recording media. In such a process, a web of biaxially oriented polyethylene terephthalate, acetates, polyolefins, or other conventional polymeric films, which are in the range of 0.0015 inch to 0.005 inch thick, and are from 12 inches to 48 inches in width, are coated with a layer of coating liquid, or ink, which is in the range of from 0.00025 inch to 0.0055 inch thick.

A typical photoconductor ink is a Newtonian liquid, whereas a typical magnetic recording ink is a non-Newtonian liquid. The present invention has utility in the coating of both general classes of liquids.

A great number of means and apparatus exist which operate to coat such liquids onto a moving web. For example, an excess amount of liquid may be applied, with excess liquid thereafter being removed by operation of a doctor knife. Also, a roller may be used to transport liquid from a pool to the passing substrate; or the liquid may be extruded in a thin layer directly onto the passing web. The substrate may be routed into a reservoir of coating liquid, either as a free-running web, or while being guided by a backup roller, and air brushes or resilient wipers can be used to thereafter remove excess coating liquid from the substrate.

Another class of coating apparatus provides a pool of liquid at a coating nip through which the substrate passes. As a result, the substrate exits the coating nip carrying a thin layer of the coating liquid.

In all cases, the coating liquid is a consumable, and it must be replenished or resupplied to the pool which is immediately at the coating nip or coating interface. Generally, it is an advantage to maintain only a small amount of coating liquid at this pool, and yet the pool must be large enough to supply a uniform quantity of liquid across the length of the coating interface. These coating inks are usually dispersions which contain volatile substances. If too large a supply of ink is maintained at the coating nip, undesirable effects can result from evaporation of the volatile material and/or separation of particles from the ink's liquid constituents. Thus, it is desirable to maintain no more than an adequate amount of ink at the coating nip, and it is desirable that this minimal amount of ink be available in a uniform amount along the length of the coating nip.

Exemplary means of supplying ink to a coating interface are shown, for example, in U.S. Pat. Nos. 4,038,442 and 4,142,010. In the former patent, coating ink is directly applied to a substrate by the use of a die-like coating head which includes a number of discharge conduits or ports. In the latter patent, a die-like coating head is also provided. In this case, a runner conduit (48) holds a quantity of the ink, and supplies the ink to a coating slot (38) by way of a comb-like shim (20). This shim operates to control the flow of ink between the reservoir and the coating slot.

U.S. Pat. No. 4,299,186 is similar in its teaching to U.S. Pat. No. 4,142,010.

Copending, and commonly assigned U.S. Patent application Ser. No. 316,367, filed Oct. 29, 1981, now U.S. Pat. 4,387,124 describes a flow manifold which supplies a non-Newtonian liquid to a coating pool by way of a multi-conduit manifold. This manifold is constructed and arranged such that all ink entering the coating pool has experienced the same identical flow history, and is thus of the same viscosity.

SUMMARY OF THE INVENTION

The present invention provides a flow manifold which supplies a uniform quantity of ink to the length of a coating nip, for example to a coating pool, such that uniform-thickness coating occurs, while at the same time storage of a quantity of coating ink at the coating nip is minimized.

More specifically, the manifold of the present invention supplies ink to a runner conduit which spans substantially the full length of the coating nip. This runner conduit communicates with the coating nip by way of a unique construction and arrangement of flow conduits of non-uniform flow restriction properties.

The present invention can be readily understood by considering the following example. Assume a coating apparatus which includes a two-foot long pool.

The present invention, in its simplest form, provides a manifold which includes a runner conduit of uniform cross section extending substantially the length of pool. The runner is pump-supplied with ink at the runner's midpoint. Ink flows out of the runner, to the coating pool, by way of a plurality of openings, conduits or slots of graduated flow-restriction characteristic. More specifically, more restriction-to-flow is provided immediately adjacent the point of pump-supply-input, and restriction-to-flow gradually decreases as the two opposite ends of the runner are approached. As a result, equal quantity of ink flows from the runner to the entire length of the pool.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
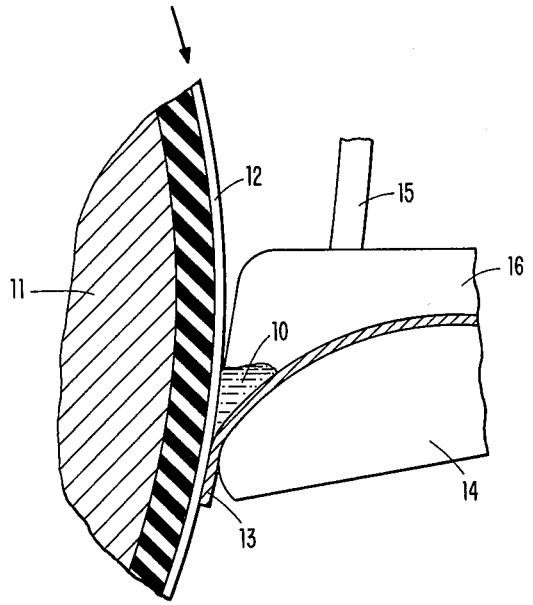
FIG. 1 PRIOR ART
FIGS. 1 and 2 are two exemplary prior art coating stations which include the present invention.

FIG. 1 is taken from U.S. Pat. No. 3,081,191. In this patent, a coating liquid pool 10 is contained at a coating nip defined by the confluence of roller 11, web 12 and steel shim stock 13. Steel shim stock 13 is non-compliantly supported by metal shoe 14. Pool 10 is shown in cross section, and is elongated in a direction perpendicular to the figure. Coating liquid is resupplied to pool 10 by way of conduit 15 and manifold 16 of the present invention.

Figure 2:
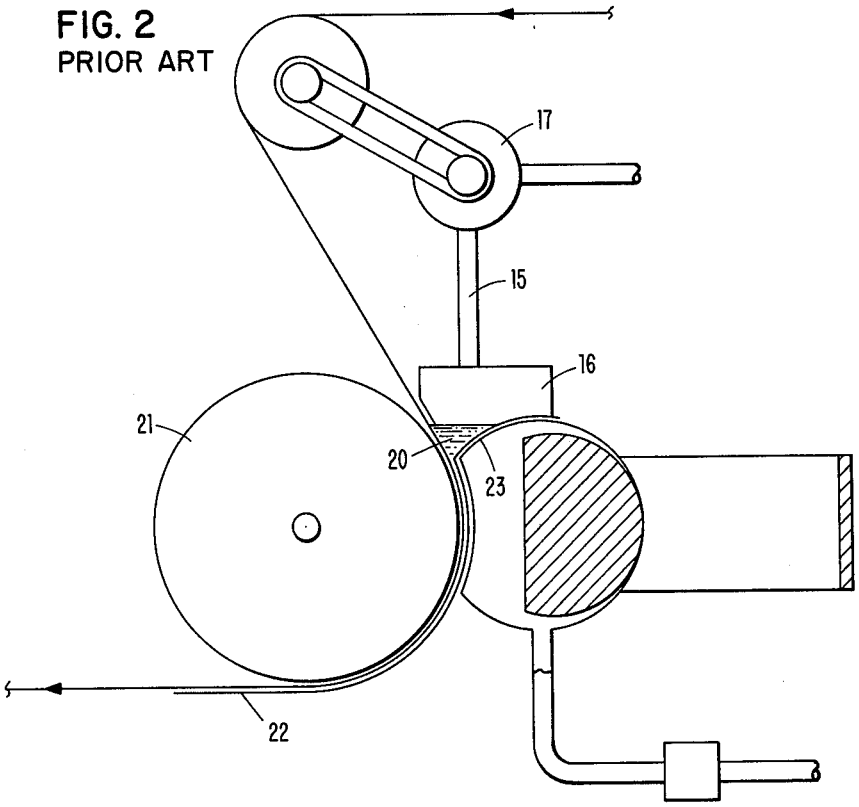
FIG. 2 PRIOR ART

FIG. 2 is taken from U.S. Pat. No. 4,345,543. In this coating station, pool 20 is contained at a coating nip defined by the confluence of roller 21 and flexible smoothing flap 22. Flap 22 is made of plastic, and it is compliantly supported by pressurized membrane 23. Pool 20 is also elongated in the direction perpendicular to the figure. Pool 20 is resupplied with coating liquid by way of conduit 15, pump 17, and manifold 16 of the present invention.

The present invention provides an improved means of resupplying coating ink or liquid to such elongated pools, for example.

Figure 3:
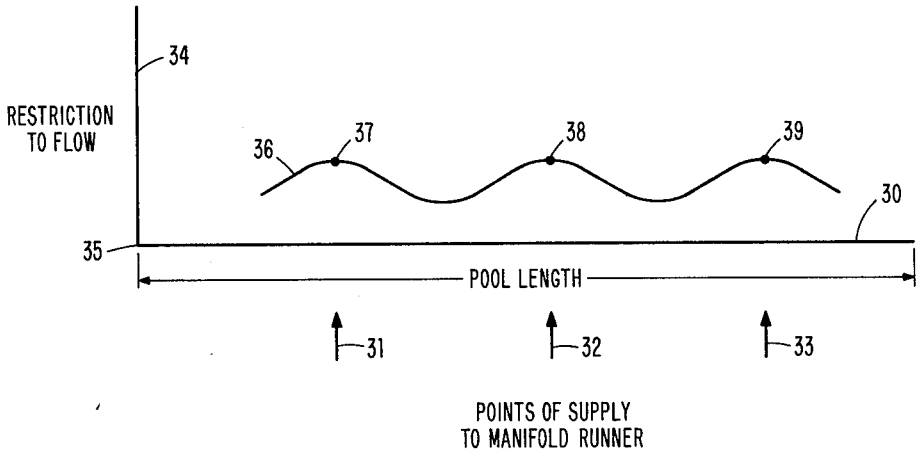
FIG. 3 is a conceptual showing of the present invention.

Conceptually, the present invention can be understood by considering FIG. 3. This figure depicts, on axis 30, the length of a coating pool, such as is shown in FIGS. 1 and 2. Arrows 31, 32 and 33 represent the physical location, along the aforesaid manifolds, of three identical inlet ports or conduits. Axis 34 depicts, in arbitrary units, increasing restriction-to-flow, in the upward direction from origin 35. Curve 36, an idealized curve for purposes of discussion, is the manner in which the aforesaid manifold's restriction-to-flow means provides graduated restriction-to-flow from the manifold's internal runner conduit to the coating pool. Points 37, 38 and 39 show that since the input flow to the runner conduit at the three inlets 31, 32 and 33 is identical, the restriction-to-flow is not only maximum at points 37, 38 and 39, but it is also identical. If, for example, the inlet pressure at 32 was higher than at 31 and 33, then, restriction-to-flow would be higher at 38. Whatever the shape of curve 36, in accordance with the present invention, the quantity of coating ink flow from the length of the manifold, to the length of the coating pool, is equal for the pool length which is spanned by the manifold's internal runner conduit.

The following description deals with a specific manifold constructed and arranged in accordance with the present invention. However, the present invention is not to be limited to the specifics of this manifold.

Figure 4:
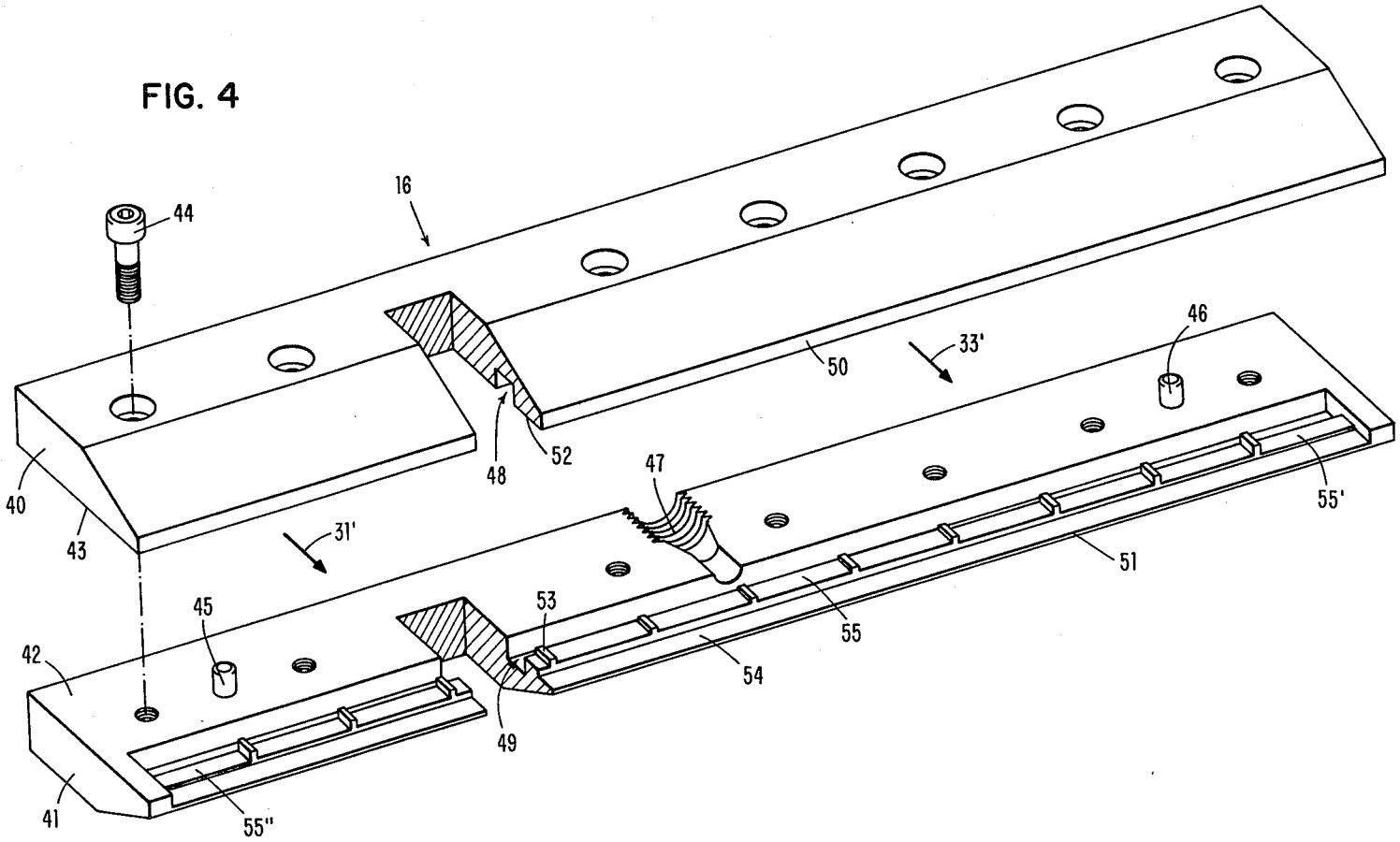
FIG. 4 shows the details of one embodiment of the present invention, modifications of which comprise other embodiments of the present invention.

FIG. 4 shows the detail of one embodiment of the present invention. Variations thereof, which comprise other embodiments of this invention, will be described, and yet other embodiments will be apparent to those of skill in the art.

Manifold 16 comprises a pair of mating metal (aluminum) bars 40 and 41 whose mating, planar surfaces 42 and 43 are machined to closely fit together when bolt 44 (eight in number) is threaded into bar 41. Metal pins 45 and 46 are received by holes (not shown) in surface 43, in order to accurately locate the two bars relative one another.

In this embodiment, each bar carries one-half of a thread section 47 which provides input of coating liquid to an elongated runner conduit defined by mating channels 48 and 49, in bars 40 and 41, respectively. This runner conduit is shown as having a rectangular cross section. It could just as well be of circular cross section. Also, the runner conduit could, if desired, be formed entirely within bar 41, with bar 40 serving as a cover for the conduit. However this conduit is formed, it is preferably of uniform cross section, the length of the conduit; however, this is not essential.

Channels 48 and 49 run generally parallel to aligned and mating front edges 50 and 51 of manifold 16.

Bar 43 includes a flat, planar portion 52 which mates with upstanding partitions 53 (eleven in number) formed in bar 41. Bar 41 includes a recessed surface 54, forward of partitions 53, which cooperates with the forward edge of surface 52 to define a reflow or liquid-blending slot outlet for the manifold, from which the coating liquid flows as a sheet to the aforesaid coating pool.

The top surfaces of partitions 53 all lie in the same plane, i.e. the plane of surface 42. Thus, when bars 40 and 41 are assembled, the top surfaces of partitions 53 abut surface 52.

A critical feature of the present invention involves the construction and arrangement of partitions 53 and the surfaces 55 which lie intermediate adjacent partitions 53. More specifically, the flow channels (conduits, openings or slots) defined by surface 52, surface 55, and adjacent partitions 53 define flow-restricting means. The restriction to flow which is presented, between channel 48–49 and manifold outlet slot 52, 54, is of graduated characteristic, along the length of channel 48–49. That is, surfaces 55 are not in a common plane. More specifically, surfaces 55 immediately adjacent inlet 47 are closer to surface 52 than are surfaces 55' and 55'' which lie at opposite ends of channel 48–49. In addition, this spacing to surface 52 gradually decreases as inlet 47 is approached from both ends 55' and 55''.

In this manner, uniform flow is achieved between channel 48–49 and the blending or reflow outlet slot defined by spaced surfaces 54 and 52.

The quantity of flow provided to inlet 47 is such that channel 48–49 is at all times maintained full of coating liquid, down the entire length of the conduit. As a result, a uniform-quantity sheet of liquid flows out of manifold outlet 50–51 to the coating pool.

While the flow restricting means of FIG. 4 comprises a plurality of individual flow ports (52, 55, 53) of rectangular cross section, and of individually different cross-sectional area, the present invention contemplates other geometries which likewise present graduated restriction to flow between an internal runner conduit (48–49) and an output flow slot (52, 54). Also, while partitions 53 are shown as having a rectangular cross section, it may be desirable to provide a tapered or oval-shaped cross section, extending in the direction of liquid flow. When FIG. 4 is compared to FIG. 3, FIG. 4's inlet 47 is equivalent to a single inlet such as FIG. 3's inlet 32. FIG. 4 could be modified to provide two additional inlets, at 31' and 33'. In this case, surfaces 55 immediately opposite inlets 31' and 33' would be closely spaced to surface 52, to thereby establish the restriction to flow represented by points 37 and 39 of FIG. 3.

In an exemplary construction of the present invention, manifold 16 was about 1.5 feet long. The spacing of parallel surfaces 52 and 54 established a reflow outlet slot about 0.062 inch high, as established by the spacing of surfaces 52 and 54. This slot was about 0.25 inch long (i.e., in the direction of flow). The spacing of surfaces 55 and 52 was graduated from a minimum of about 0.015 inch adjacent inlet 47, to a maximum of about 0.025 inch adjacent the opposite ends (55', 55'') of runner conduit 48–49.

The depth of partitions 53 (i.e., in the direction of flow) was about 0.1875 inch, and partitions 53 were about 0.0625 inch thick (i.e., in the direction parallel to conduit 48–49). The length-spacing of adjacent partitions 53 (i.e., in the direction parallel to conduit 48–49) was about 1.035 inches. Runner conduit 48–49 had a cross-sectional area of about 1.34 square inches. These dimensions were found to be optimum for a (Newtonian) liquid of about 70X2 CPS viscosity at 22° C., which liquid was supplied to conduit 48–49 at a rate of about 250 cubic CM per minute.

The above manifold arrangements can also be used in association with a pool which coats, for example, the gravure roll of a gravure coating station.

Another example of use is to coat the roll of a reverse-roll coating station.

While the invention has been particularly shown and described with reference to preferred embodiments thereof, it will be understood by those skilled in the art that various changes in form and details may be made therein without departing from the spirit and scope of the invention.

What is claimed is:

1. In a coating apparatus wherein a substrate passes through an elongated pool of coating liquid, and thereafter emerges with a liquid coating on at least one side of said substrate, the improvement comprising:

an elongated liquid-supply manifold for replenishing coating liquid to said pool, said manifold including at least one input port from supplying liquid to an internal, elongated runner-conduit, and graduated flow-restriction means operable to supply liquid from said runner to spaced portions of said pool; as liquid flows in a direction from said runner-conduit, through said flow-restrictng means, to said pool, said flow-restriction means comprise a plurality of individual flow-passages of graduated cross-sectional area as measured normal to said direction of flow, and of equal length as measured in said direction of flow, and said plurality of flow-passages terminating in an elongated slot whereat the individual flows recombine, the outlet of said slot communicating with said pool.

2. The coating apparatus of claim wherein said manifold includes a plurality of input ports, and said flow restriction means is constructed and arranged to offer maximum resistance to flow adjacent each of said input ports, with said resistance to flow gradually decreasing to a minimum, and then gradually increasing to a maximum as the distance between adjacent input ports is traversed.

3. The coating apparatus of claim 1 wherein said flow-restricting means comprises a plurality of elongated slot-like passages of substantially equal width, as measured parallel to the length of said runner conduit and to the length of said pool; of substantially equal length, as measured in the direction of flow; and of graduated unequal height, said unequal height providing said graduated restriction to flow.

4. The coating apparatus of claim 3 wherein said plurality of slot-like passages terminates in an elongated slot which extends parallel to the length of said runner conduit, such that the individual flow streams of said passages recombine in said slot, and then flow to said pool.

5. In a coating apparatus wherein a substrate passes through an elongated pool of coating liquid, and thereafter emerges with a liquid coating on at least one side of said substrte, the improvement comprising:

an elongated liquid-supply manifold for replenishing coating liquid to said pool, said manifold including a plurality of input ports for supplying liquid to an internal, elongated runner-conduit; and graduated flow-restriction means operable to supply liquid from said runner to spaced portions of said pool, said flow restriction means being constructed and arranged to offer maximum resistance to flow adjacent each of said input ports, with said resistance to flow gradually decreasing to a minimum, and then gradually increasing to a maximum as the distance between adjacent input ports is traversed.

* * * * *